US007730879B2

(12) United States Patent
Maul et al.

(10) Patent No.: US 7,730,879 B2
(45) Date of Patent: Jun. 8, 2010

(54) METHOD AND DEVICE FOR IGNITING A COMBUSTIBLE GAS MIXTURE IN A COMBUSTION ENGINE

(76) Inventors: Georg Maul, Salvatorianer Weg 14, 88410 Bad Wurzach (DE); Dieter Kuhnert, Fr.-Metz-Strasse 18, 74889 Sinsheim (DE); Gerhard Koerner, Waldweg 72, 81182 Roevershagen (DE)

( * ) Notice: Subject to any disclaimer, the term of this patent is extended or adjusted under 35 U.S.C. 154(b) by 171 days.

(21) Appl. No.: 11/991,821

(22) PCT Filed: Aug. 19, 2006

(86) PCT No.: PCT/EP2006/008187

§ 371 (c)(1),
(2), (4) Date: Mar. 11, 2008

(87) PCT Pub. No.: WO2007/031172

PCT Pub. Date: Mar. 22, 2007

(65) Prior Publication Data

US 2009/0139504 A1 Jun. 4, 2009

(30) Foreign Application Priority Data

Sep. 15, 2005 (DE) ..... 10 2005 043 972

(51) Int. Cl.
*F02P 1/08* (2006.01)
*F02P 1/00* (2006.01)

(52) U.S. Cl. ..... 123/603; 123/656

(58) Field of Classification Search ..... 123/594, 123/596, 601, 603, 605, 618, 634, 637, 638, 123/656; 336/200; 361/263; 315/219
See application file for complete search history.

(56) References Cited

U.S. PATENT DOCUMENTS

| | | | | |
|---|---|---|---|---|
| 3,169,212 | A * | 2/1965 | Walters | 315/223 |
| 3,620,201 | A * | 11/1971 | Warren et al. | 123/637 |
| 3,945,362 | A | 3/1976 | Neuman et al. | |
| 4,136,301 | A | 1/1979 | Shimojo et al. | |
| 4,193,385 | A | 3/1980 | Katsumata et al. | |
| 4,998,526 | A | 3/1991 | Gokhale | |
| 5,115,793 | A | 5/1992 | Giaccardi et al. | |
| 5,156,136 | A | 10/1992 | Okumura | |
| 5,163,411 | A | 11/1992 | Koiwa et al. | |
| 5,521,573 | A * | 5/1996 | Inoh et al. | 336/180 |
| 5,554,908 | A | 9/1996 | Kuhnert et al. | |
| 5,598,135 | A * | 1/1997 | Maeda et al. | 336/200 |
| 6,023,214 | A * | 2/2000 | Ohta et al. | 336/84 R |
| 6,526,953 | B1 * | 3/2003 | Inagaki | 123/609 |
| 6,568,774 | B2 * | 5/2003 | Hitzschke et al. | 315/246 |
| 6,859,130 | B2 * | 2/2005 | Nakashima et al. | 336/200 |
| 2004/0040535 | A1 | 3/2004 | Miwa et al. | |

FOREIGN PATENT DOCUMENTS

| | | |
|---|---|---|
| DE | 100 15 613 A1 | 10/2001 |
| GB | 1 249 667 A | 10/1971 |

* cited by examiner

*Primary Examiner*—Mahmoud Gimie

(57) ABSTRACT

A voltage transformer circuit for supplying ignition power to a spark plug includes a transformer, a primary circuit, and a secondary circuit. The primary circuit is coupled with the secondary circuit via the transformer in order that, when a transistor switch is closed, power is transmitted from the primary circuit into the secondary circuit. The primary circuit includes a discharge path, for demagnetizing the transformer when the transistor switch is open and via which power can be retransmitted from the secondary circuit for shortening the duration of an arc discharge, and the discharge path forms a demagnetizing current with a primary side of the transformer.

13 Claims, 4 Drawing Sheets

METHOD AND DEVICE FOR IGNITING A COMBUSTIBLE GAS MIXTURE IN A COMBUSTION ENGINE

The invention relates to a method for igniting a combustible gas mixture in an operating cycle of a combustion engine by means of an ignition system, including a spark plug and a voltage transformer circuit for supplying the spark plug with ignition power, wherein the voltage transformer circuit comprises a transformer, a primary circuit in which a primary side of the transformer is arranged, and a secondary circuit in which a secondary side of the transformer is arranged and wherein electric power is fed into the primary circuit and a primary voltage U1 is applied to the primary side of the transformer by closing a switch. The primary voltage U1 is transformed up by means of the transformer and is transmitted into the secondary circuit via a transformer core so that a secondary voltage U2($t$) is built up on the spark plug connected to the secondary circuit and an arc discharge is ignited when a critical ignition voltage value $U_z$ has been reached. Furthermore, the invention relates to a voltage transformer circuit, an ignition system and a transformer suitable for the method.

An operating cycle of a combustion engine comprises the introduction of the combustible gas mixture into a combustion chamber, the ignition of the gas mixture and the combustion of the gas mixture. A new operating cycle of the combustion engine is initiated when the combustion chamber is filled with fresh gas again.

Such methods and voltage transformer circuits, in which the power transmission from the primary circuit into the secondary circuit takes place during an initiating phase, that is, when the circuit is closed, use the forward converter principle. The use of forward converters for ignition systems was proposed in DE 100 15 613 A1. In the known ignition system, the high voltage generation takes place on the secondary side in partial resonance so that an arc discharge with a combustion period in the millisecond range can be subsequently heated by repeated voltage pulses for any amount of time so as to ensure a reliable ignition of the gas mixture by means of an extended combustion period even under unfavorable conditions, for example turbulences in the ignition chamber of the engine.

In particular with engines, which are operated with higher intermediate pressures of 14 bar to 25 bar, a reliable ignition is only possible according to the state of the art with an increased effort and with relatively short maintenance intervals of the ignition system.

It is an object of the invention to show a way for extending the maintenance intervals of ignition systems.

With a method of the afore-mentioned type, this object is achieved in that, for quenching the arc discharge, power is retransmitted from the transformer core and from the secondary circuit into the primary circuit by discharging the transformer via a discharge path contained in the primary circuit by means of a demagnetizing current, while power is prevented from being transmitted from the primary circuit into the secondary circuit until another arc discharge is ignited, preferably during the remaining time of the operating cycle of the combustion engine.

The object is furthermore solved by means of a voltage transformer circuit for supplying ignition power to a spark plug comprising a forward converter with a transformer having a primary side and a secondary side which are coupled via a transformer core, a primary circuit in which the primary side of the transformer, connections for a primary voltage source and a transistor switch are arranged for initiating the primary voltage, and a secondary circuit in which the secondary side of the transformer and connections for a spark plug are arranged, wherein the primary circuit is coupled with the secondary circuit via the transformer in such a manner that power is transmitted from the primary circuit into the secondary circuit when the transformer switch is closed. A discharge path via which the transformer can be demagnetized when the transistor switch is open and via which power can be retransmitted from the secondary circuit into the primary circuit for shortening the duration of an arc discharge, is arranged in the primary circuit and the discharge path forms a demagnetizing circuit with the primary side. Said demagnetizing circuit is embodied in such a manner that a transmission of power from the demagnetizing circuit into the secondary circuit can be prevented.

It was recognized within the context of the invention that considerably smaller ignition powers are sufficient for a reliable ignition of a combustible gas mixture than are introduced into the gas mixture with known ignition systems at combustion periods of the arc discharge of several 100 μs or even milliseconds. For shortening the arc's duration, power is thus retransmitted in the instant invention from the secondary circuit and the transformer core into the primary circuit after the ignition of the arc discharge and a transmission of power from the primary circuit into the secondary circuit is prevented during the remaining time of the operating cycle of the combustion engine. After the ignition of the arc discharge, an accelerated reduction of the secondary voltage U2($t$) connected to the spark plug is thus achieved so that the arc discharge already comes to a standstill after a relatively short combustion period. The shortened combustion period thus leads to a reduction of the wear of the electrodes of the spark plug so that the maintenance intervals of the ignition system can be increased.

The extension of the maintenance intervals achieved with the invention is an important advantage, in particular for gas engines. Gas engines are used in power plants for generating electricity by the combustion of natural gas. Maintenance operations and in particular the replacement of a defective spark plug are associated with loss of production and thus with considerable costs.

Due to strict emission regulations, gas engines are operated with lean gas mixtures to an ever increasing extent, that is, gas mixtures with an excess of air and increased pressure. Even though the ignition of the gas mixture is made more difficult with the leaning as well as with the rise of the gas pressure, it was determined in the context of the invention that an ignition in the normal operating range of a combustion engine can already be reliably achieved with a combustion period of the arc discharge of less than 1 μs, even under such conditions. As compared to the state of the art, the wear of spark plugs can thus be clearly reduced in that the combustion period of the arc discharge is limited to less than 50 μs, preferably less than 20 μs, more preferably less than 10 μs and in particular less than 5 μs, for example.

In the context of the invention, the surprising insight was furthermore gained that the ignition voltage value $U_z$ at which an arc discharge ignites in a gas mixture, is not only a function of the composition of the gas mixture, its pressure and the electrode distance of the spark plug, but also of the voltage rise speed of the secondary voltage U2($t$). The faster the secondary voltage U2($t$) rises, the lower the ignition voltage value $U_z$, at which an arc discharge ignites.

To further reduce the ignition power introduced into the gas mixture and to thus further reduce the wear of the spark plugs, steep rising edges of the secondary voltage U2($t$), that is, high slew rates, are preferred with the instant invention. If, for example, the time period of the voltage rising edge of the secondary voltage U2($t$) is shortened from 100 μs to 5 μs, the ignition voltage value $U_z$, at which the arc discharge ignites, is shortened by approximately 10%.

A possibility for increasing the voltage slew rate of the secondary voltage U2($t$) is to choose a higher primary voltage U1 than is required with the used ignition system for igniting an arc discharge. Preferably, the primary voltage U1 is thus chosen to be at least twice as high, more preferably at least three times as high, in particular at least five times as high as is required with the used ignition system for igniting an arc discharge in the gas mixture, which is to be ignited.

Due to the impact of parasitic capacities, among other things, which are inevitably present in an ignition system, the minimum value of the primary voltage U1, which is required for igniting an arc discharge in the gas mixture, which is to be ignited, can generally not be calculated or can only be calculated with extremely high effort. However, when adjusting an ignition system, the minimum value of the primary voltage U1 can be easily determined by trial and error, in that the primary voltage U1 is slowly lowered while the engine is running until there is no ignition.

The method according to the invention is characterized by short durations of the arc discharge and thus provides for less wear of the used spark plugs and for longer maintenance intervals. It was found within the context of the invention that an ignition of the combustible gas mixture is not always effected, in particular with a combustion period of the arc discharge of less than 15 μs, under certain operating conditions of the combustion engine, in particular during a start phase or change of load phase. Even though the ignition method according to the invention brings about a reliable ignition, even with very brief combustion periods of less than 10 μs in normal operation of a motor, for example, special conditions can arise in the intermediate operation of an engine, with which the reliability of the ignition carried out according to the invention can be improved.

A simple possibility for improving the ignition reliability is to generate a plurality of consecutive arc discharges during an operating cycle of a combustion engine. Said arc discharges can each be quenched within a few microseconds. An aspect of the invention thus relates to a method for igniting a combustible gas mixture in an operating cycle of a combustion engine by means of a spark plug, wherein a spark plug consecutively ignites an arc discharge several times, in particular at least three times, during the operating cycle.

While the instant method according to the invention retransmits power from the transformer core and the secondary circuit into the primary circuit during normal operation of a combustion engine for quenching the arc discharge by discharging the transformer via a discharge path contained in the primary circuit by means of a demagnetizing current and while during the remaining time of the operating cycle of the combustion engine power is prevented from being transmitted from the primary circuit into the secondary circuit, power is prevented from being transmitted from the primary circuit into the secondary circuit only until another arc discharge, which is still ignited in the same operating cycle, is ignited for the purpose of improving the ignition reliability outside of the normal operation of the combustion engine.

With the use of a voltage transformer circuit according to the invention, a single spark plug can consecutively ignite a plurality of arc discharges in brief time intervals of less than 30 μs, for example. Gas mixtures can thus also be reliably ignited outside of the normal operation of a combustion engine, in particular during a starting phase.

Further details and advantages of the invention are defined by means of exemplary embodiments with reference to the enclosed drawings. Components which are the same and which correspond to one another are thereby identified with corresponding reference numerals. The described features can be used individually or in combination so as to create preferred embodiments of the invention. In the Figures FIG. 1 shows a circuit sketch of an exemplary embodiment of a voltage transformer circuit according to the invention;

Figure 4:
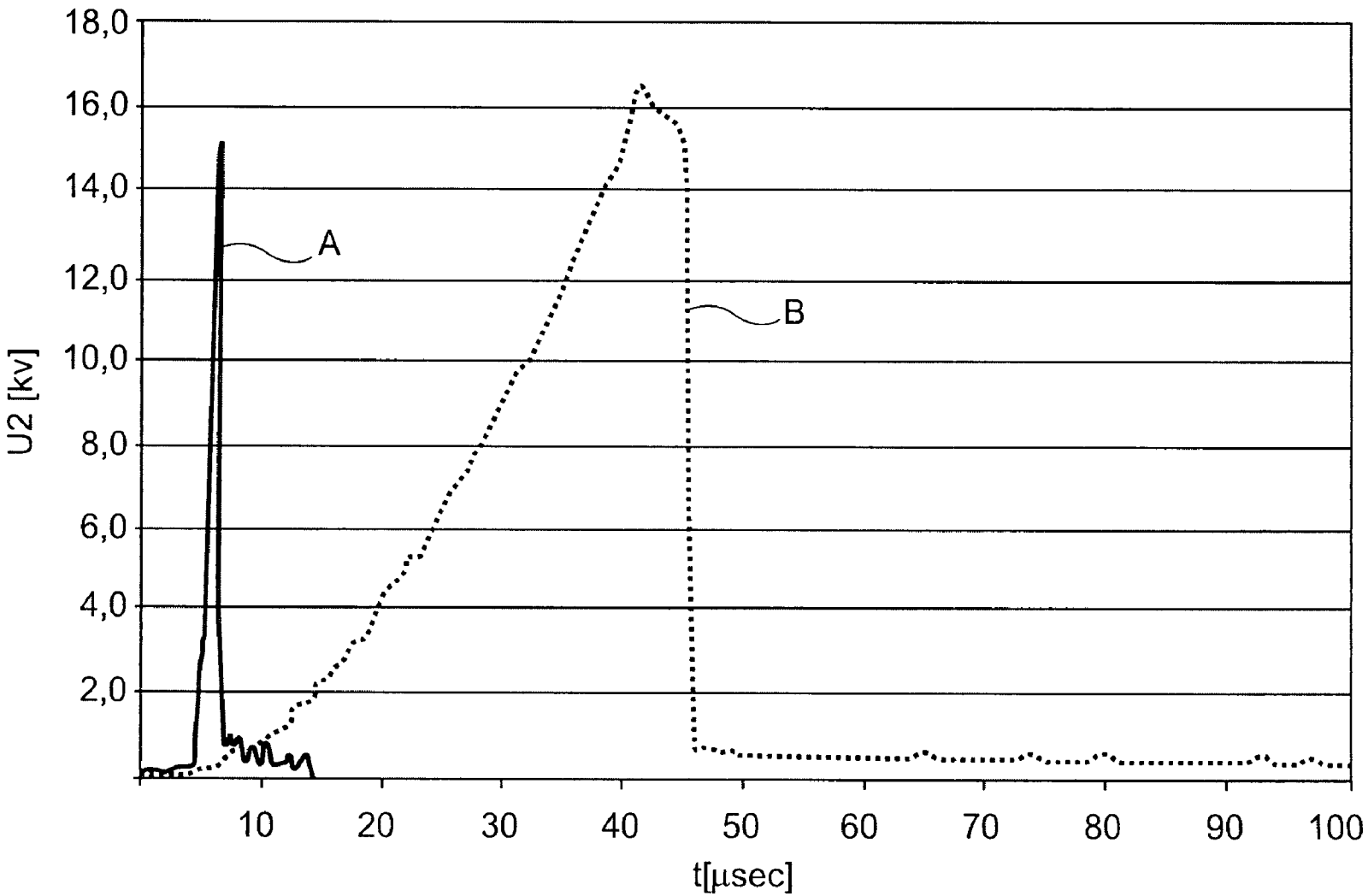
Figure 5:
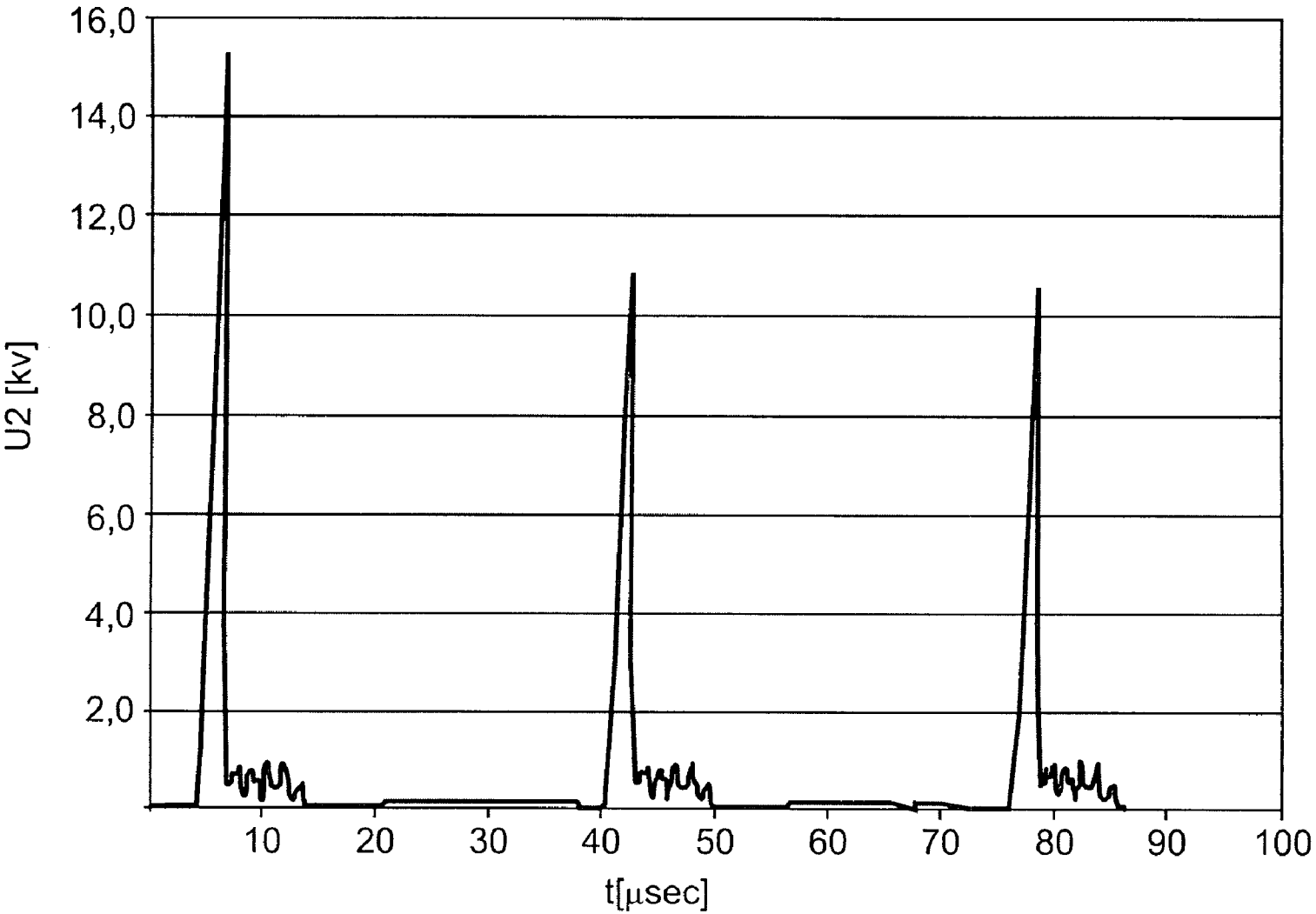

FIG. 4 shows the course of the secondary voltage U2($t$) over the time t for an ignition system according to the invention and for an ignition systems according to the state of the art; and FIG. 5 shows the course of the secondary voltage U2($t$) over the time t for an ignition system according to the invention in response to a generation of a plurality of arc discharges by means of a single spark plug for effecting a reliable ignition outside of the normal operation of the engine.

Figure 1:
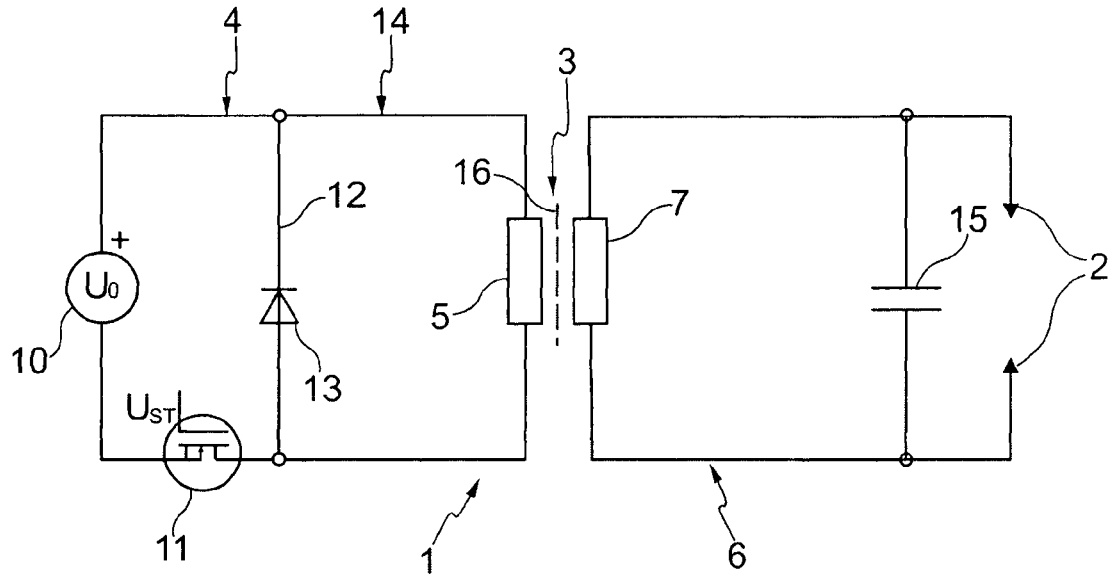

FIG. 1 illustrates a circuit sketch of a voltage transformer circuit 1, with which ignition power can be supplied to a spark plug for igniting a combustible gas mixture in a combustion engine. The voltage transformer circuit 1 comprises a transformer 3, a primary circuit 4 in which a primary side 5 of the transformer 3 is arranged and a secondary circuit 6 in which a secondary side 7 of the transformer 3 is arranged. A spark plug 2, which is schematically illustrated in FIG. 1 by means of opposite arrows, is connected to the secondary side 7 of the transformer 3. Reference numeral 15 identifies parasitic capacities, which are inevitably present in the secondary circuit 6 and which are a result of the winding capacities of the secondary side 7 of the transformer 3, in particular.

The primary circuit 4 is connected to the primary voltage source 10. The primary voltage source 10 is a direct current voltage source, which preferably provides a primary voltage U1 of 100V to 400V. The primary voltage U1 can be connected to the primary side 5 of the transformer 3 by closing a transistor switch 11 arranged in the primary circuit 4. Field effect transistors, in particular switching power field effect transistors with a circuit time of less than 100 μs, is preferably less than 50 μs, more preferably less than 20 μs are particularly well suited. Suitable transistors are sold, for example, by IXYS under the name HiPerFET. The field effect transistor switch 11 is switched between an off-state and a conductive state by means of a control voltage UST in a manner which is familiar to the person skilled in the art. For the purpose of protecting the field effect transistor 11 against voltage reversals, an integrated diode is connected thereto in parallel in reverse-biasing.

In the circuit illustrated in FIG. 1, the primary circuit 4 and the secondary circuit 6 coupled thereto form a forward converter. The coupling of the primary circuit 6 is carried out via the ceramic core 16 of the transformer 3. The primary voltage U1 is connected to the primary side 5 of the transformer 3 by closing the transistor switch 11. In so doing, electric power is fed into the primary circuit 4. The primary voltage U1 is transformed up and transmitted into the secondary circuit 6 by means of the transformer 3 so that a secondary voltage U2($t$) builds up on the spark plug 2.

On the one hand, the speed with which the secondary voltage U2($t$) rises is a function of the magnitude of the primary voltage U1 and, on the other hand, of the magnitude of the inductivities and capacities, which are included in the voltage transformer circuit 1 and in the spark plug 2 and which are charged via inevitable ohmic resistances. As soon as the secondary voltage U2(*t*), which is connected to the spark plug 2, reaches a critical ignition voltage value $U_z$, an arc discharge ignites.

To shorten the combustion period of the arc discharge and to thus reduce the wear of the spark plug 2 caused by burnout, the voltage transformer circuit 1 illustrated in FIG. 1 includes in the primary circuit 4 a discharge path 12, which is connected in parallel to the primary side 5 of the transformer 3 and via which the primary side 4 is short-circuited for a demagnetizing current when the transistor switch 11 is open. A blocking element 13, which prevents a charge current, which flows when the transistor switch 11 is closed, from flowing through the discharge path 12, is arranged in the discharge path. However, the blocking element 13 allows for the demagnetizing current for discharging the transformer, which flows in reverse direction, to pass. In the illustrated exemplary embodiment, the blocking element 13 is embodied as a diode. As a matter of principle, a second transistor switch, for example, which is controlled in a suitable manner, can also be used as a blocking element 13.

As soon as the arc discharge has ignited, it is quenched again in that power is directed from the secondary circuit back into the primary circuit via the discharge path 12. As soon as the transistor switch 11 is opened, a demagnetizing current begins to flow via the discharge path 12. Initially, power stored in the primary side 5 of the transformer 3 is discharged by means of this demagnetizing current and, due to the inductive coupling of the primary side 5 with the secondary side 7, power, which is also stored in the secondary side 7 and in the capacity 2, is removed.

In so doing, the electric power transmitted into the secondary circuit 6 when the transistor switch 11 is open, is only partly released as ignition power by a discharge current, which flows in the arc discharge, to the gas mixture, which is to be ignited. Said electric power is partly transmitted back again into the primary circuit, where it dissipates at ohmic resistances, which are inevitably present in the discharge path 12 and on the primary side 5.

The opening of the transistor switch 11 marks the end of the initiating phase in which the electric power is transmitted from the primary circuit into the secondary circuit and it marks the onset of the discharge phase, in which power is directed back from the secondary circuit into the primary circuit. The period of the initiating phase is chosen in such a manner that the ignition of an arc discharge and an ignition of the gas mixture are achieved in a reliable manner. Aging effects of the spark plug, which over time require a slightly higher secondary voltage U2(*t*) for igniting the arc discharge, are to be considered thereby.

In particular with gas mixtures, which are difficult to ignite, it can be expedient to open the transistor switch 11 only after the ignition of the arc discharge. For example, the initiating phase can be twice as long as the period between the closing of the transistor switch 11 and the ignition of the arc discharge. Preferably, however, the transistor switch 11 is opened less than 20 μs, preferably less than 10 μs, in particular less than 5 μs after the ignition of the arc discharge. More preferably however, the transistor switch 11 is opened at the latest at that moment in which the arc discharge ignites. Particularly short ignition periods can be obtained in that the transistor switch 11 opens and in that the redirection of power into the primary circuit 4 is initiated after a period, which is only 50% to 95%, preferably 50% to 90%, more preferably 50% to 80% of the period, which passes between the closing of the transistor switch 11 and the ignition of the arc discharge.

The length of time of the initiating phase of an ignition system is chosen by means of empirical values, which can be determined in corresponding tests. The discharge phase, in which the transistor switch 11 is in its blocking state and which follows the starting phase, lasts until the end of the present operating cycle of the combustion engine. The transistor switch 11 is thus closed again only after a fresh gas mixture has been introduced into the combustion chamber of the engine and when said gas mixture is to be ignited.

In the illustrated voltage transformer circuit 1, the discharge path 12 forms a demagnetizing circuit 14 with the primary side 5. Said demagnetizing circuit 14 is configured in such a manner that power is prevented from being transmitted from the demagnetizing circuit 14 into the secondary circuit 6 during the discharge phase. In this regard, the illustrated voltage transformer circuit 1 has the opposite effect of known high voltage capacitor ignition systems, in which a forward converter is operated in resonance with the secondary circuit so that the primary side, after opening the transistor switch, represents an oscillating circuit, which initially withdraws power from the secondary circuit by demagnetizing the transformer and which feeds power back into the secondary circuit in response to a subsequent semi-oscillation.

Figure 2:
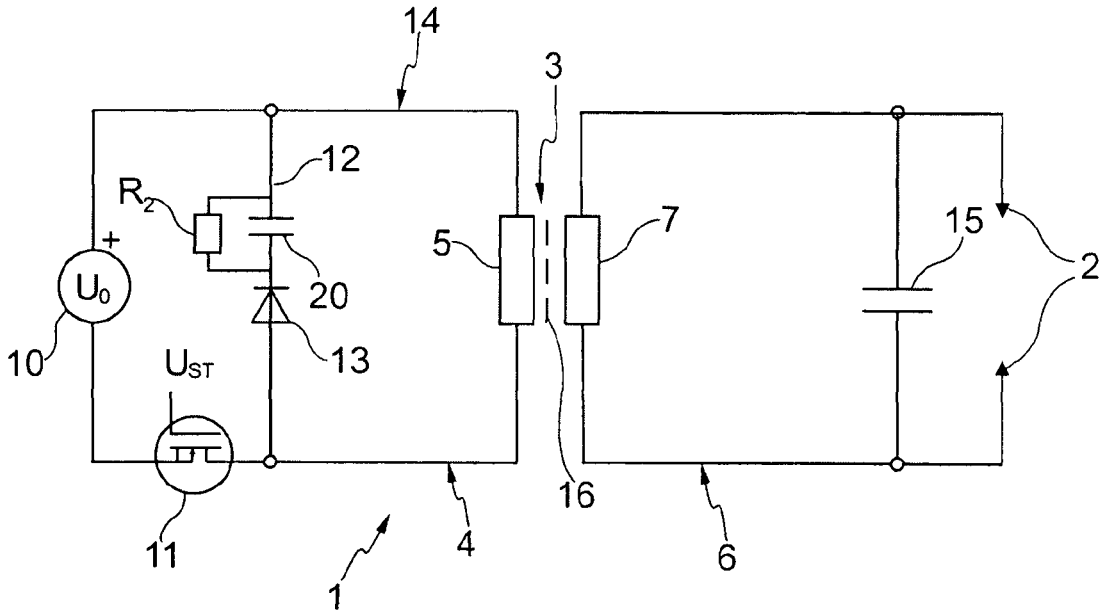
FIG. 2 shows a circuit sketch of a further exemplary embodiment of a voltage transformer circuit according to the invention.

A further exemplary embodiment of a voltage transformer circuit 1 with which a shortened combustion period of an arc discharge can be achieved is illustrated in FIG. 2. The difference to the voltage transformer circuit 1 illustrated by means of FIG. 1 is that a capacitor 20 is arranged in the discharge path 12. The capacitor 20 is charged by means of a demagnetizing current in response to the opening of the transistor switch 11, which is arranged outside of the demagnetizing circuit 14. The diode 13 prevents the capacitor 20 from subsequently discharging again and power stored in the discharge path 12 from being directed back into the transformer 3. Until the next time the transistor switch 11 is closed, that is, until the onset of the next initiating phase in the next cycle of the engine, the capacitor 20 is discharged via the resistor R2. The resistor R2 can generally represent any load. A retransmission of power from the demagnetizing circuit into the secondary circuit during the current cycle of the combustion engine would counteract the desired effect of a shortening of the combustion period and is thus undesirable.

The voltage transformer circuits 1 described by means of FIGS. 1 and 2 are suited in particular for ignition systems, which include a prechamber spark plug. Prechamber spark plugs are known from EP 0675272 B1, for example, which in this regard is incorporated in the instant application by reference. In prechamber spark plugs, the ignition electrodes of the spark plug are protected in a prechamber against possible turbulences of the igniting gas mixture. An ignition of the gas mixture can thus already be achieved with particularly brief combustion periods of the arc discharge of only 1 μs, for example, because the ignition power released by the arc discharge is not distributed across a larger region by means of turbulences.

The highest possible voltage rise speeds of the secondary voltage U2(*t*) are advantageous for the described method for igniting a combustible gas mixture in a combustion engine. Even though the voltage transformer circuits 1 illustrated by means of FIGS. 1 and 2 also make it possible for existing ignition systems to be retrofitted without exchanging the relatively expensive transformer and to obtain longer maintenance intervals, voltage transformer circuits 1 according to the invention are preferably operated with the transformer illustrated in FIG. 3, which enables particularly high voltage rise speeds.

With the illustrated transformer 3, the windings of the secondary side 7 are embodied as conductor tracks 31 connected in series on printed circuit boards 32. Up to 600 windings, for example, can be arranged in a spiral manner on a surface of a printed circuit board 32 without problems. Preferably, 50 to 200 windings, preferably 60 to 100 windings are arranged on a printed circuit board. Higher numbers of windings can be realized, for example, in that a printed circuit board 32 is equipped on both sides with conductor tracks 31, which form windings and/or in that a plurality of such printed circuit boards are arranged as a packet according to FIG. 3.

Figure 3:
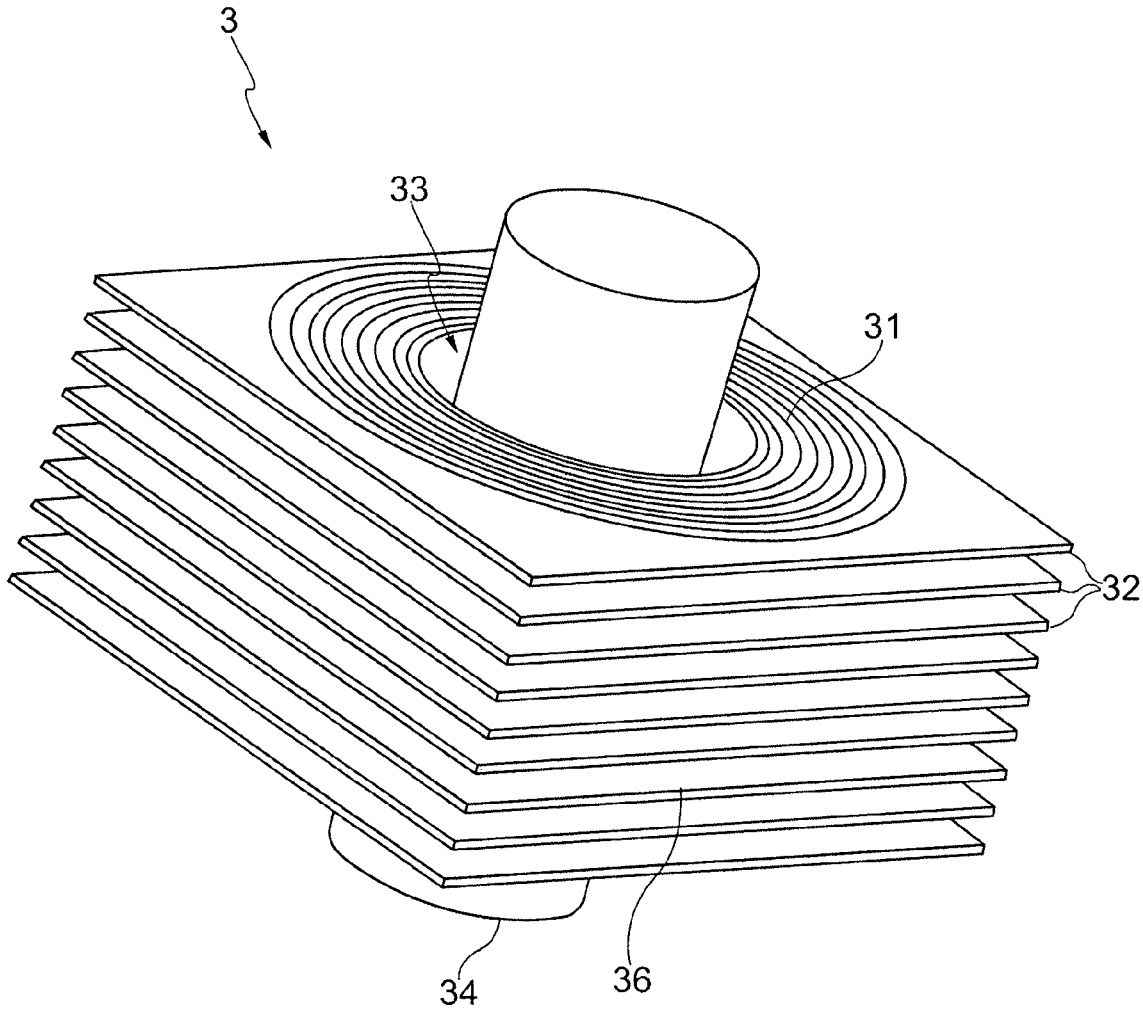
FIG. 3 shows a schematic illustration of an exemplary embodiment of a transformer for a voltage transformer circuit according to the invention.

In the exemplary embodiment illustrated in FIG. 3, 9 printed circuit boards 32 are arranged in series. The individual printed circuit boards 32 have an opening 33, through which a transformer core 34 is guided, which is made of a ceramic material. The person skilled in the art is aware of corresponding ceramic materials comprising a rapid magnetizing behavior, which are suitable for high frequency technology and which are available in stores.

With the illustrated transformer 3, the primary side 5 can be realized with a few windings, in an extreme case even with a single winding, which is bent around the transformer core 34 in a U-shaped manner. Preferably, the primary side 5, however, is formed by a printed circuit board 32, on which one or a plurality of windings are arranged as conductor tracks. With the transformer 3 illustrated in FIG. 3, the inductivities of the primary side 5 and of the second side 7 as well as parasitic capacities, which are illustrated with reference numeral 15 in FIGS. 1 and 2, and the ohmic total resistance can be minimized so that extremely rapid voltage rise speeds of the secondary voltage U2(*t*) can be realized. The spiral arrangement of the windings 31 on the individual printed circuit boards 32 makes it possible for only relatively small voltage differences to ever exist between adjacent windings 31 and for it to be possible to avoid a breakdown.

Gaps between adjacent printed circuit boards 32 as well as between the transformer core 34 and printed circuit boards 32 are filled with an electrically strong casting compound 36, for example the casting compound sold by Tyco Electronics under the name Guronic C500-0. Greater voltage differences can thus be realized between the individual printed circuit boards 32. Preferably, the transformer is arranged in a transformer housing, which was filled with the casting compound after the introduction of the transformer core 34 and the printed circuit boards 32.

If the secondary side 6 has a total of N2 windings, the potential difference between windings 31 adjacently located on a surface of a printed circuit board 32 is only U2/N2. If all of the windings of the secondary side of the transformer 3 are arranged on n printed circuit board surfaces, there is a potential difference of U2/*n* between windings of adjacent printed circuit board surfaces (that is, front and back of a printed circuit board 32 or between the windings of adjacent printed circuit boards 32, if the printed circuit boards 32 are coated on both sides). The occurring potential differences are thus much lower than with common coils made of wire windings, which are wound around a transformer core 34 in a plurality of layers, because there are considerable potential differences between windings of different layers in the state of the art and because they come to rest next to one another regardless.

FIG. 4 illustrates the behavior A of the secondary voltage U2 of an ignition system according to the invention over the time t, which comprises a voltage transformer circuit 1 according to FIG. 1 comprising a transformer according to FIG. 3. For comparison, behavior B of the secondary voltage U2 of a modern ignition system according to the state of the art is also illustrated.

Both curves show a rising edge of the secondary voltage U2, which quickly drops in response to the ignition of the arc discharge. That is to say, if an arc discharge ignites, the electric resistance of the plasma formed by the arc discharge is considerably smaller than the electrical resistance of the gas mixture. The ignition of an arc discharge thus leads to a rapid drop of the secondary voltage U2, with a simultaneous rise of the secondary current I2, which flows in the arc discharge.

On the one hand, FIG. 4 shows that a considerably steeper rising edge of the secondary voltage U2 is realized with the ignition system according to the invention (curve A) and, on the other hand, that the arc discharge already ignites at approximately 15 kV, while an arc discharge ignites only at approximately 16.5 kV, due to the considerably slower voltage rise of the ignition system according to the state of the art (curve B).

In both cases, the secondary voltage U2 drops down to a value of less than 800 V within a very short time period after the ignition of the arc discharge. At this value, the arc discharge burns until ignition power available in the secondary circuit 6 is exhausted. In the ignition system according to the state of the art, this takes several 100 μs so that the ending of the arc discharge cannot be seen in FIG. 4. In the ignition system according to the invention, the arc discharge, however, is already quenched after a combustion period of less than 10 μs. On the one hand, this is due to the fact that, at the outset, less ignition power is introduced into the secondary circuit 6 of an ignition system according to the invention, because the secondary voltage U2 only reaches a maximal value, which is approximately 10% less and, on the other hand, this is due to the fact that the introduced ignition power is redirected into the primary circuit 4 via the discharge path 12 after the ignition of the arc discharge.

Even though the course of the secondary voltage U2 illustrated in FIG. 4 leads to a reliable ignition during normal operation of a combustion engine, it may possibly not be sufficient for a reliable ignition of the gas mixture outside of the normal operation, for example, during a heating or change of load phase of the combustion engine. To always effect an ignition with the highest degree of reliability, the afore-described ignition system can thus consecutively ignite an arc discharge, which is, in each case, quenched again after a few microseconds, for example after less than 20 μs, by redirecting power from the transformer core and the secondary circuit into the primary circuit. When using the exemplary embodiments of a voltage transformer circuit described by means of FIGS. 1 and 2, this takes place in that the transformer is discharged by means of a demagnetizing current via a discharge path, which is included in the primary circuit.

FIG. 5 shows the behavior of the secondary voltage U2 over the time t in response to the ignition of a plurality of arc discharges during an operating cycle in an exemplary manner.

When using hook spark plugs, it is known in the state of the art to consecutively ignite two arc discharges so as to achieve a reliable ignition even under unfavorable conditions. In response to the double ignition of a hook spark plug, which is known from the state of the art, a high turbulence and gas flow takes place in the combustion chamber so that different conditions are at hand for both of the arc discharges and so that it can thus be assumed that sufficiently favorable conditions are at hand for an ignition of the gas mixture at least in response to the second arc discharge. However, when using a prechamber spark plug, a gas flow, which impacts the ignition conditions of the gas mixture does not occur in the prechamber between the arc discharges, which follow one another in an operating cycle of the engine. Instead of thus carrying out a reliable ignition by means of a second arc discharge in case the first ignition attempt fails in response to an improved mixing, the afore-described ignition system is able to reliably achieve the effect of an arc discharge, which burns for a longer period, and thus also an ignition under difficult circumstances by means of consecutive arc discharges. Even though a largely reliable ignition can be achieved with the afore-described ignition system by means of two consecutive arc discharges, even under unfavorable conditions, it may be advantageous, in particular during the starting phase of the combustion engine, to ignite an arc discharge during the operating cycle by means of the spark plug at least three times, in particular at least five times.

If a plurality of arc discharges are consecutively ignited during the operating cycle of the combustion engine by means of the spark plug, it is particularly advantageous to ignite these arc discharges at such a time interval that the first arc discharge ignites at an ignition voltage value $U_z$, which is at least 10% higher, preferably at least 15% higher, more preferably at least 20% higher, in particular at least 25% higher than the ignition voltage value of the arc discharges, which follow in the operating cycle of the combustion engine. In so doing, it is possible to minimize the entire ignition power raised by means of the consecutive arc discharges and thus also to minimize the wear of the used spark plugs. That is to say, if the arc discharges occur within a sufficiently short interval, plasma is available around the ignition electrode of the spark plug even after the quenching of a preceding arc discharge. The increased electrical conductivity of the plasma facilitates the ignition of another arc discharge.

In the behavior of the secondary voltage U2, which is illustrated in FIG. 5 in an exemplary manner, it can clearly be seen that the ignition voltage value $U_z$ of the first arc discharge is approximately 25% higher than the ignition voltage values of the two subsequent arc discharges. In the exemplary embodiment illustrated in FIG. 5, the arc discharges were ignited at a time interval of less than 15 μs. Generally, it is advantageous to ignite consecutive arc discharges at a time interval of less than 100 μs, preferably less than 70 μs and in particular less than 50 μs. Breaks between consecutive arc discharges during the operating cycle are advantageous from 1 μs to 50 μs, particularly advantageous from 10 μs to 30 μs, in particular at least 20 μs.

LIST OF REFERENCE NUMERALS

1 voltage transformer circuit
2 spark plug
3 transformer
4 primary circuit
5 primary side of the transformer
6 secondary circuit
7 secondary side of the transformer
10 primary voltage source
11 switch
12 discharge path
13 blocking element
14 demagnetizing circuit
15 capacity
20 capacitor
31 windings
32 printed circuit boards
33 opening
34 transformer core
36 casting compound
t time
U1 primary voltage
U2 secondary voltage

What is claimed is:

1. A voltage transformer circuit for supplying ignition power to a spark plug comprising a forward converter comprising a transformer comprising a primary side and a secondary side, which are coupled via a transformer core, a primary circuit, in which the primary side of the transformer, connections for a primary voltage source and a transistor switch for engaging the primary voltage U1 are arranged, and a secondary circuit, in which the secondary side of the transformer and connections for a spark plug are arranged, wherein the primary circuit is coupled with the secondary circuit via the transformer in such a manner that, when the transistor switch is closed, power is transmitted from the primary circuit into the secondary circuit, the primary circuit comprises a discharge path, via which the transformer can be demagnetized when the transistor switch is open and via which power can be retransmitted from the secondary circuit for shortening the duration of an arc discharge, and the discharge path forms a demagnetizing circuit with the primary side, which is configured by means of a diode in the discharge path in such a manner that power can be prevented from being transmitted from the demagnetizing circuit into the secondary circuit, the diode preventing a current emanating from the primary voltage source from flowing through the discharge path when the transistor switch is closed and permitting a demagnetizing current for demagnetizing the transformer to pass when the transistor switch is open.

2. The voltage transformer circuit according to claim 1, wherein the primary side of the transformer is bypassed by the blocking element.

3. The voltage transformer circuit according to claim 1, wherein the transistor switch is arranged outside of the demagnetizing circuit.

4. The voltage transformer circuit according to claim 1, wherein the primary side of the transformer comprises less than 20 windings.

5. The voltage transformer circuit according to claim 1, wherein the secondary side of the transformer comprises 50 to 1000 windings.

6. An ignition system for igniting a combustible gas mixture in a combustion engine, comprising a voltage transformer circuit according to claim 1 and a spark plug.

7. The ignition system according to claim 6, wherein the spark plug is a prechamber spark plug.

8. A transformer for a voltage transformer circuit according to claim 1, comprising a primary side and a secondary side, wherein windings on the secondary side are embodied as conductor tracks on a circuit board and gaps between the printed circuit boards are filled with a casting compound.

9. The transformer according to claim 8, wherein the secondary side comprises a plurality of printed circuit boards, on which windings are arranged as conductor tracks.

10. The transformer according to claim 8, wherein the at least one printed circuit board comprises an opening, around which the windings are arranged and though which a transformer core protrudes.

11. The transformer according to claim 8, wherein the windings are arranged in a helical manner.

12. The transformer according to claim 8, wherein the transformer core is made of a ceramic material.

13. The transformer according to claim 8, wherein the windings of the primary side arc embodied on a printed circuit board.

* * * * *